US010112624B2

(12) United States Patent
Duer

(10) Patent No.: US 10,112,624 B2
(45) Date of Patent: Oct. 30, 2018

(54) CABLE CAR SYSTEM

(71) Applicant: INNOVA PATENT GMBH, Wolfurt (AT)

(72) Inventor: Gerd Duer, Bildstein (AT)

(73) Assignee: Innova Patent GmbH, Wolfurt (AT)

( * ) Notice: Subject to any disclaimer, the term of this patent is extended or adjusted under 35 U.S.C. 154(b) by 79 days.

(21) Appl. No.: 15/127,485

(22) PCT Filed: Dec. 4, 2014

(86) PCT No.: PCT/AT2014/000217
§ 371 (c)(1),
(2) Date: Sep. 20, 2016

(87) PCT Pub. No.: WO2015/154106
PCT Pub. Date: Oct. 15, 2015

(65) Prior Publication Data

US 2017/0144675 A1 May 25, 2017

(30) Foreign Application Priority Data

Apr. 10, 2014 (AT) ..... A 269/2014

(51) Int. Cl.
*B61B 1/00* (2006.01)
*B61B 12/10* (2006.01)
(Continued)

(52) U.S. Cl.
CPC ..... *B61B 12/105* (2013.01); *B61B 1/00* (2013.01); *B61B 7/04* (2013.01); *B61B 12/122* (2013.01); *B61B 15/00* (2013.01)

(58) Field of Classification Search
CPC ..... B61B 12/105; B61B 1/00; B61B 7/04; B61B 12/122; B61B 5/00
See application file for complete search history.

(56) References Cited

U.S. PATENT DOCUMENTS 4,641,585 A * 2/1987 Tarassoff ..... B61B 12/022 104/173.2
4,699,064 A * 10/1987 Tarassoff ..... B61B 12/105 104/163
(Continued)

FOREIGN PATENT DOCUMENTS

CH 692694 A5 9/2002
EP 0125967 A1 11/1984
(Continued)

*Primary Examiner* — Jason C Smith
(74) *Attorney, Agent, or Firm* — Laurence A. Greenberg; Werner H. Stemer; Ralph E. Locher

(57) ABSTRACT

A cable car system includes vehicles that are clamped to a hauling cable along the route and decoupled from the hauling cable upon entering the stations. The vehicles are moved through the stations by control tires which are coupled to one another by gear mechanisms and driven via a supporting pulley for the hauling cable. The control tires are mounted on a supporting frame on at least one supporting structure. The rotation of the supporting pulley that drives the control tires is derived from the hauling cable by way of a drive belt. The drive belt runs over the supporting pulley, which is mounted on a pivotable rocker, and over at least one control tire. The pivotable rocker is mounted on the supporting structure for the supporting frame, or the pivotable rocker is mounted on a supporting structure to which the supporting frame is not attached.

6 Claims, 4 Drawing Sheets

(51) Int. Cl.

| | |
|---|---|
| ***B61B 7/04*** | (2006.01) |
| ***B61B 12/12*** | (2006.01) |
| ***B61B 15/00*** | (2006.01) |

(56) References Cited

U.S. PATENT DOCUMENTS

| | | | | |
|---|---|---|---|---|
| 5,119,733 | A * | 6/1992 | Brochand | B61B 12/105 104/112 |
| 5,690,031 | A * | 11/1997 | Bach | B61B 12/105 104/168 |
| 8,522,689 | B2 | 9/2013 | Beck | |
| 2012/0042803 | A1* | 2/2012 | Beck | B61B 12/105 104/112 |
| 2014/0069292 | A1* | 3/2014 | Duer | B61B 12/024 104/197 |
| 2016/0016593 | A1* | 1/2016 | Luger | B61B 3/02 104/87 |
| 2017/0144675 | A1* | 5/2017 | Duer | B61B 12/105 |

FOREIGN PATENT DOCUMENTS

| | | | |
|---|---|---|---|
| EP | 0770532 | A1 | 5/1997 |
| EP | 2420424 | A1 | 2/2012 |
| JP | H0659183 | U | 8/1994 |
| JP | H08183450 | A | 7/1996 |
| JP | 2012041037 | A1 | 3/2012 |

* cited by examiner

CABLE CAR SYSTEM

BACKGROUND OF THE INVENTION

Field of the Invention

The present invention relates to a cable car system having a hauling cable which is guided over a guide pulley in each of the two end stations of the system, and having vehicles, such as cabins or chairs, which can be coupled to the hauling cable and which are formed with a clamping device and with an undercarriage, wherein they are coupled to the hauling cable along the route and are decoupled from the hauling cable when they enter the stations, are guided by means of the undercarriages along guide rails through the stations in which the passengers get on and off, and are coupled again to the hauling cable on exiting the stations, wherein the movement of the vehicles in the stations is furthermore undertaken by means of control tyres, namely decelerating tyres, conveying tyres and accelerating tyres, which are coupled to one another by gear mechanisms, wherein the speed of the vehicles after their decoupling from the hauling cable is reduced by the decelerating tyres, furthermore the vehicles are moved by means of the conveying tyres at a slow speed through the passenger entry and exit area in which the passengers get on and off, and the speed of the vehicles is increased by means of the accelerating tyres, whereupon they are again coupled to the hauling cable and are moved out of the station, furthermore the drive of the control tyres is undertaken by at least one supporting pulley, located in the respective station, for the hauling cable, wherein the control tyres are mounted on a supporting frame which is located on at least one supporting structure and the at least one of those supporting pulleys for the hauling cable, via which the drive of the control tyres is diverted by means of a drive belt from the hauling cable, is mounted on at least one pivotably mounted rocker or the like, and the drive belt is placed over this at least one supporting pulley and over at least one control tyre.

A cable car system of this kind is known from the EP 2420424 A1. This known cable car system is therefore advantageous compared to those cable car systems in which the drive for the control tyres is diverted from the hauling cable via at least one of the supporting pulleys for the hauling cable wherein this at least one supporting pulley is mounted on a rigid support pin which is located on the supporting frame for the control tyres, since the shocks and vibrations passing through the hauling cable to the supporting frame via the at least one supporting pulley from which the drive is diverted for the control tyres, are considerably reduced through their bearing on at least one pivotable rocker.

With this known cable car system however the at least one rocker via which the drive of the control tyres is diverted from the hauling cable by means of a drive belt, is located on the supporting frame for the control tyres, whereby shocks and vibrations pass—even if strongly dampened—to the supporting frame, thereby causing detrimental effects such as noise emissions. The present invention is thus concerned with the problem of substantially avoiding or even completely eliminating these detrimental effects.

BRIEF SUMMARY OF THE INVENTION

This is achieved according to the invention in that the at least one pivotable rocker or the like, on which the at least one supporting pulley is mounted from which the drive is diverted for the control tyres, is mounted on the supporting structure for the supporting frame or that the at least one pivotable rocker or the like is mounted on a supporting structure to which the supporting frame is not attached.

The at least one supporting structure for the supporting frame can then consist of a support column and a cross beam located thereon and the at least one rocker can be mounted at one of the two ends of the cross beam.

Furthermore a further beam can be provided at the end of the cross beam and the at least one rocker is mounted thereon.

The supporting frame for the control tyres is preferably located on at least one supporting structure, consisting of a support column and a cross beam, and a further support column is provided with a cross beam wherein the at least one pivotable rocker is located at one end of this cross beam and supports the at least one supporting pulley from which the drive for the control tyres is diverted, wherein the supporting frame is not fixed on this cross beam.

Two rockers or the like are preferably provided on which two supporting pulleys are mounted which are each coupled for entrainment by a drive belt with at least each one of the control tyres.

If the support beam for the at least one pivotable rocker or the like is attached directly to the rigid supporting structure for the supporting frame and is therefore likewise rigid, shocks and vibrations which pass from the hauling cable to the support beam are taken up by the supporting structure for the supporting frame, whereby practically no shocks or vibrations pass to the supporting frame for the control tyres. If the supporting frame is not attached to that support beam on which the rocker is mounted, then for this reason no shocks or vibrations can pass to the supporting frame.

Thus the detrimental effects associated with the known prior art are avoided through each of the two structural configurations.

BRIEF DESCRIPTION OF THE SEVERAL VIEWS OF THE DRAWING

The subject of the invention will now be explained in further detail below with reference to two exemplary embodiments illustrated in the drawings. In the drawings.

DESCRIPTION OF THE INVENTION

Figure 1:
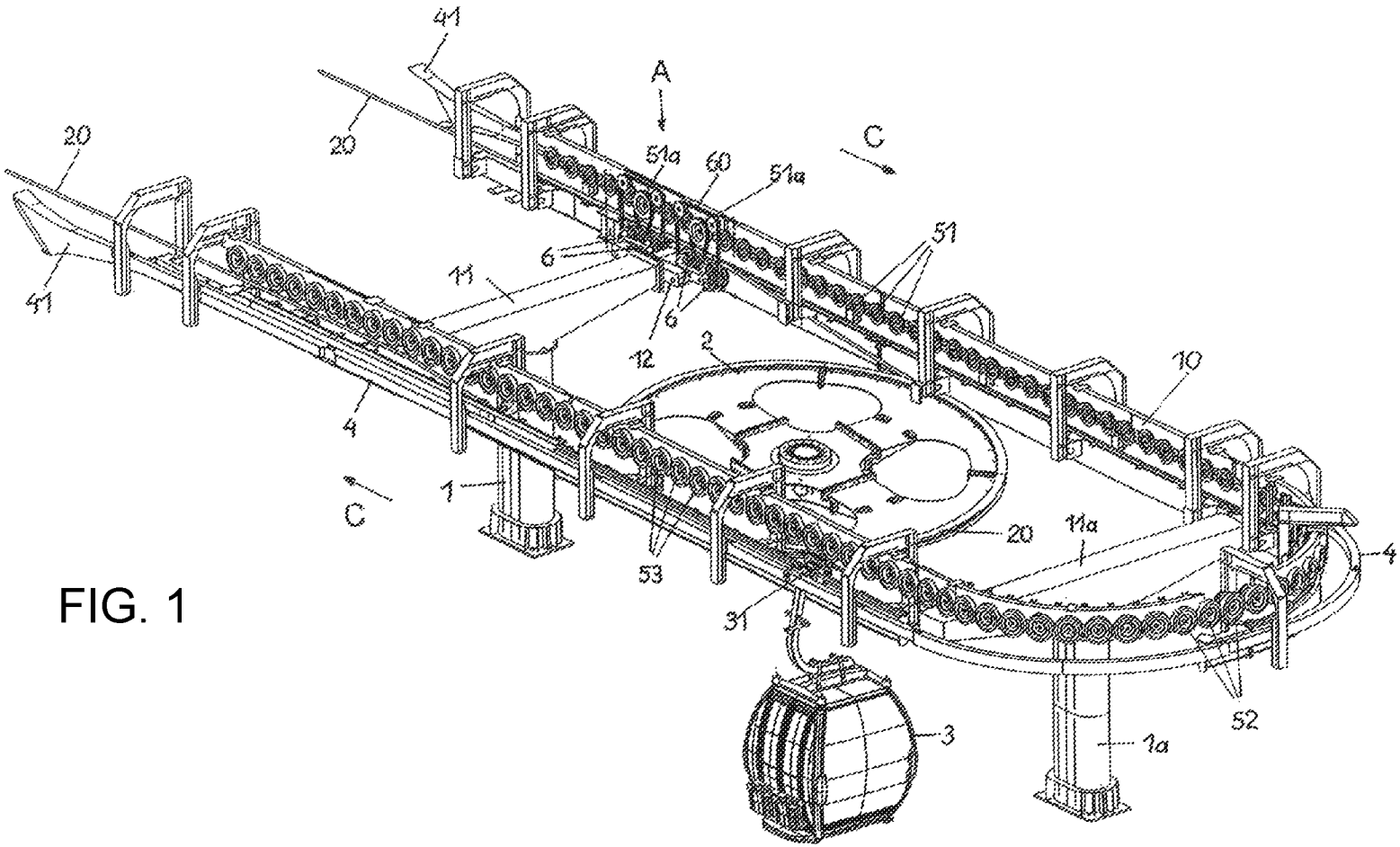
FIG. 1 shows a first embodiment of a station of a cable car system according to the invention with a supporting structure on which a supporting frame for the control tyres is located, in an axonometric illustration.

As is apparent from FIG. 1, the illustrated station of a cable car system has a supporting frame 10 supported by two support columns 1 and 1*a* and on which a guide pulley 2 is mounted with an approximately vertically aligned axis, over which a hauling cable 20 is guided. During operation of this cable car system the hauling cable 20 is moved in circulation over the guide pulley 2 by means of a drive motor, preferably located in the hill station, at a speed of e.g. 7 m/sec.

Vehicles 3, in the present case cabins, formed with undercarriages 31 can be coupled to the hauling cable 20. The vehicles 3 are coupled on the route to the hauling cable 20. On entering into the station the vehicles 3 are decoupled from the hauling cable 20 whereupon they are moved through the station along a guide rail 4 by means of the undercarriage 31. On exiting the station the vehicles 3 are again coupled to the hauling cable 20. The guide rail 4 is formed with inlet funnels 41 at their two free ends.

The direction of movement of the vehicles 3 is marked by the arrow C.

Control tyres 51, 52 and 53, which are mounted on the supporting frame 10 and which are coupled for entrainment to one another by gear means, serve to move the vehicles 3 through the station. The control tyres 51 of a first group located at the entrance to the station serve as decelerating tyres by means of which the speed of the vehicles 3 decoupled from the hauling cable 20 is reduced from e.g. 7 m/sec to e.g. 0.3 m/sec. The control tyres 52 of a second group following on here serve as conveying tyres through which the vehicles 3 are guided at a speed of e.g. 0.3 m/sec through the entrance and exit area of the station in which the passengers can get on and off. The speed of the vehicles 3 is again increased to e.g. 7 m/sec by the third group of control tyres 53 which serve as acceleration tyres, whereupon the vehicles 3 on exiting the station are coupled onto the hauling cable 20 which is revolving at this speed.

The hauling cable 20 is guided over supporting pulleys 6 which are turned by the hauling cable 20. The control tyres 51, 52 and 53 are driven in that at least one control tyre 51*a* is coupled by means of a belt 60 for rotation to at least one supporting pulley 6 for the hauling cable 20.

As is further apparent from FIG. 1, the support columns 1 and 1*a* are formed at their upper ends with cross beams 11 and 11*a*, to the two ends of which is attached the supporting frame 10 for the control tyres 51, 52, 53.

Figure 1A:
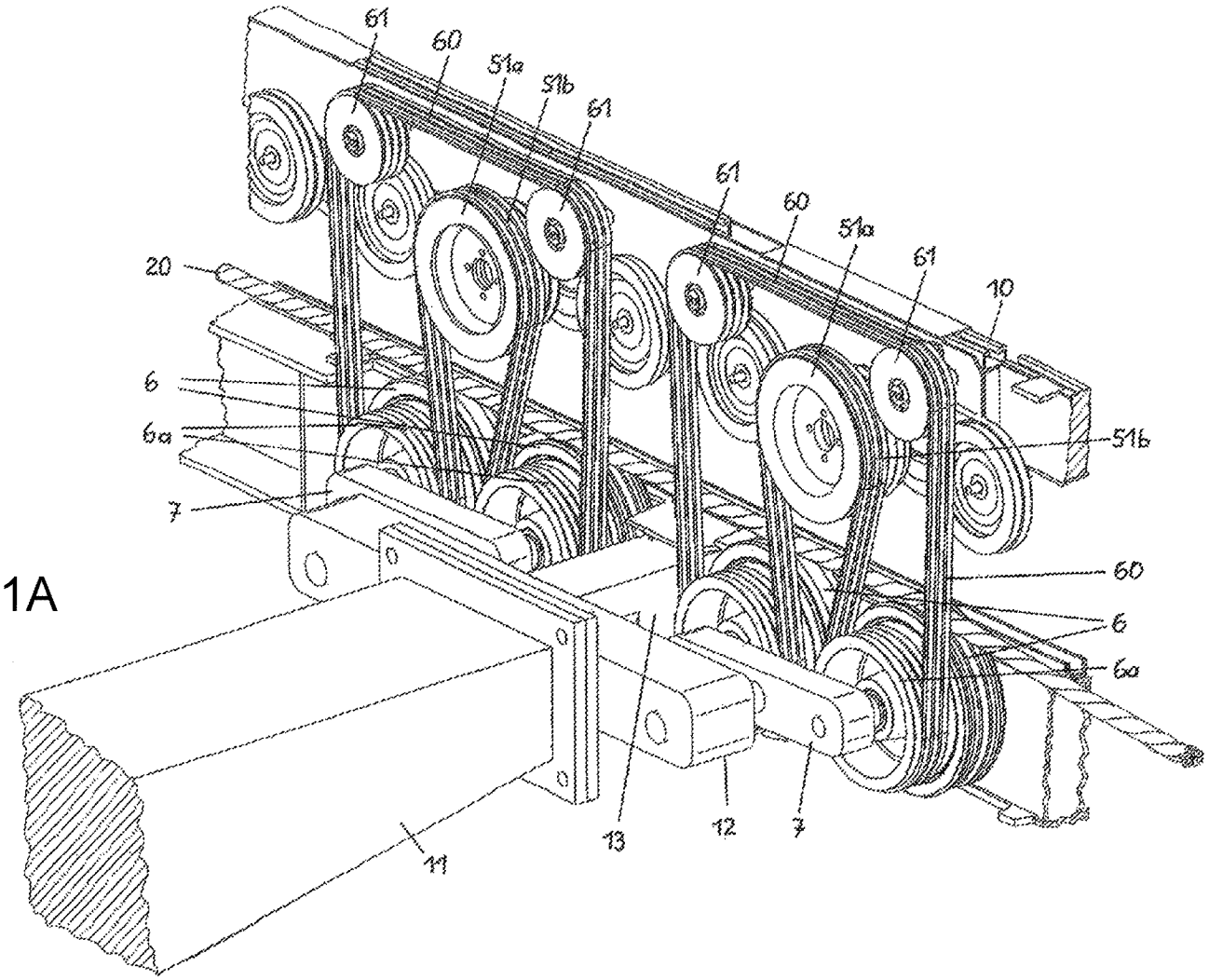
FIG. 1A shows the detail A of FIG. 1 on an enlarged scale and in an axonometric illustration.

As is apparent in particular from FIG. 1A, a support beam 12 which is rigidly attached to the cross beam 11 is located between the one end of the cross beam 11 and the supporting frame 10. Two rockers 7 are mounted on this support beam 12 and two supporting pulleys 6 for the hauling cable 20 are mounted on the rockers. A drive belt 60 is placed over each of the two pairs of the supporting pulleys 6 and is placed over two guide pulleys 61 and furthermore each over a control tyre 51*a*. The two supporting pulleys 6 are formed with the belt faces 6*a* and the two control tyres 51*a* are formed with the belt faces 51*b* for the drive belt 60. The drive for the control tyres 51*a* is diverted by means of the drive belt 60 from the hauling cable 20 via the two supporting pulleys 6 which are mounted on the rocker 7.

The control tyres 51*a* are coupled by means of gear means to the further control tyres 51, 52, 53 so that the further control tyres 51, 52, 53 have rising or decreasing revolving speeds.

A further beam 13 is rigidly attached to the support beam 12 and the supporting frame 10 is attached to this further beam. The support column 1 with the cross beam 11 and the support beam 12 make up the supporting structure for the supporting frame 10.

Since the two supporting pulleys 6 for the hauling cable 20 are located on the rocker 7, the supporting pulleys 6 are evenly loaded by the vibrations and vertical movements exerted by the hauling cable 20. Since the rockers 7 are mounted on the support beam 12 which is rigidly attached to the support column 1 by means of the cross beam 11, hardly any shocks or vibrations which would stress the supporting frame 10 and/or cause noises, pass to the supporting frame 10.

Figure 2:
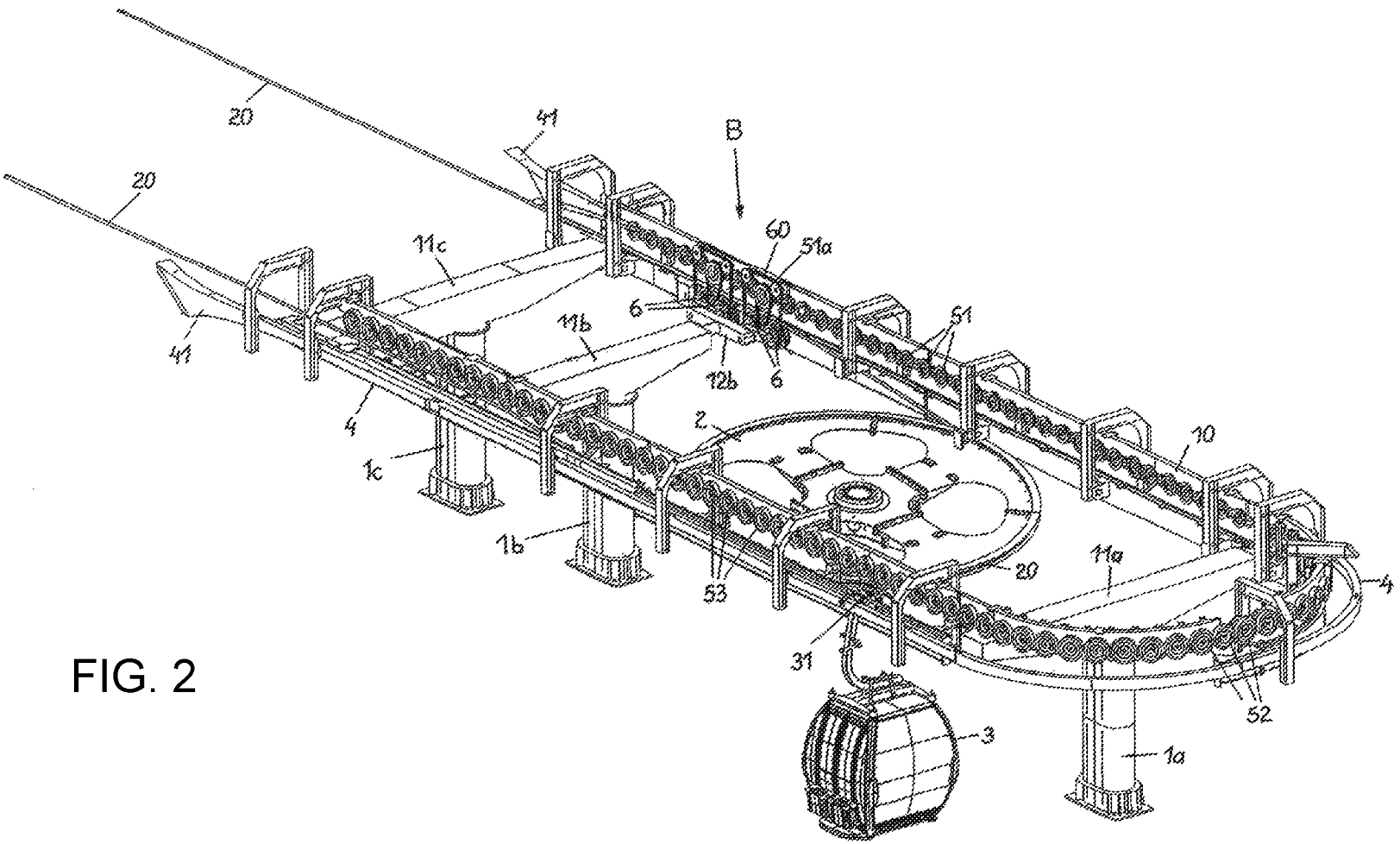
FIG. 2 shows a second embodiment of a station of a cable car system according to the invention with a supporting structure on which a supporting frame for the control tyres is located, in an axonometric illustration.

A second exemplary embodiment will now be explained with reference to FIG. 2 and FIG. 2A:

This exemplary embodiment substantially agrees with the exemplary embodiment according to FIG. 1 and FIG. 1A. Reference is thus made to the explanations on FIG. 1 and FIG. 1A. The difference in respect of FIG. 1 and FIG. 1A is however that in addition to the support column 1*a* by which the supporting frame 10 is supported, there is a second support column 1*b* with a cross beam 11*b* wherein the drive for the control tyres 51, 52, 53 is diverted from the hauling cable 20, but by which the supporting frame 10 is not supported, and that a third support column 1*c* with a cross beam 11*c* is provided by which the supporting frame 10 is supported, wherein it is fixed on the cross beam 11*c*.

Figure 2A:
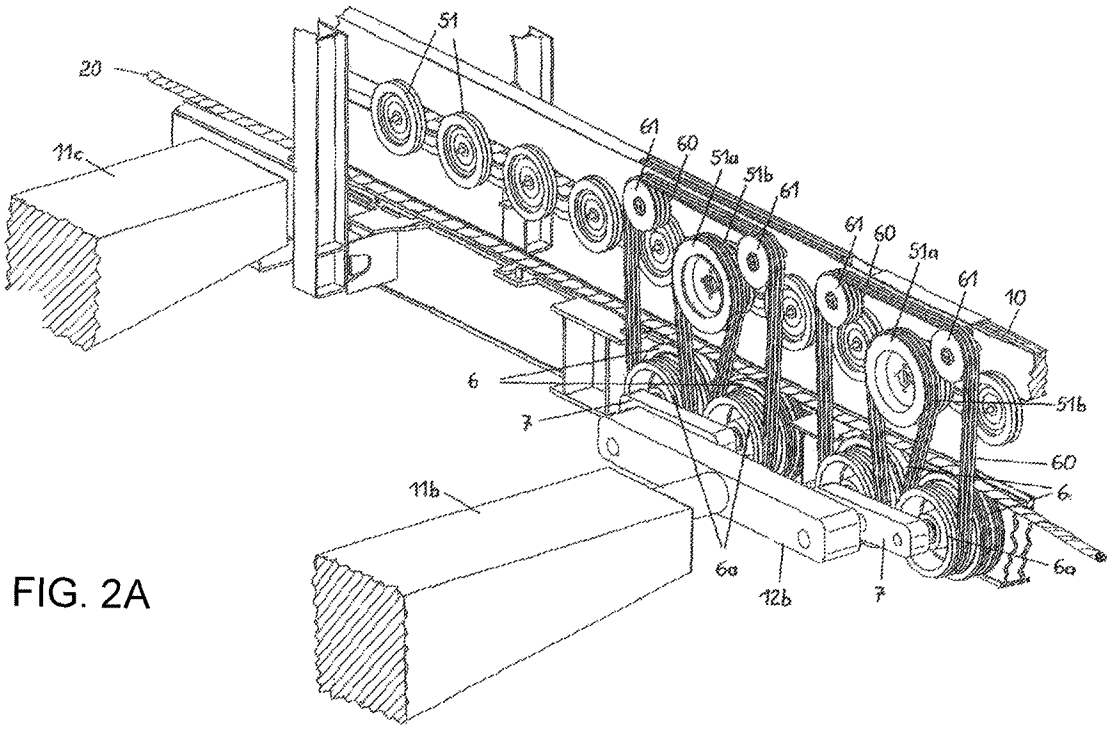
FIG. 2A shows the detail B of FIG. 2 on an enlarged scale and in an axonometric illustration.

As can be seen in particular from FIG. 2A, a support beam 12*b* is rigidly fixed to one end of the cross beam 11*b* which is located on the support column 1*b*. Two rockers 7 are mounted on this cross beam 12*b*, with two supporting pulleys 6 for the hauling cable 20 being mounted thereon. The support column 1*b* with the cross beam 11*b* and the support beam 12*b* make up the supporting structure for the two rockers 7. A drive belt 60 is guided over each of the belt faces 6*a* of the supporting pulleys 6 and is placed over two guide pulleys 61 and furthermore each over one control tyre 51*a*. The supporting frame 10 is not attached to the cross beam 11*b* or the support beam 12*b*. The function of the rockers 7 as well as the supporting pulleys 6 and their coupling with the control tyres 51*a* is the same as explained with reference to FIG. 2A.

Compared with this the supporting frame 10 is moreover supported by the support column 1*c* with the cross beam 11*c*, wherein it is rigidly fixed to the ends of the cross beam 11*c*.

Since the supporting frame 10 is not connected to the cross beam 11*b* on which the rockers 7 are mounted, no shocks or vibrations, which could cause detrimental effects, pass from the rockers 7 to the supporting frame 10.

The invention claimed is:

1. A cable car system, comprising:

a hauling cable extending between stations of the system and being guided over supporting pulleys and reversing pulleys in the stations;

vehicles to be coupled to said hauling cable along a route between the stations and decoupled from said hauling cable upon entering the stations, whereupon said vehicles are guided through the stations along guide rails to enable passengers to embark and disembark, and said vehicles are once more coupled to said hauling cable on exiting the stations;

a supporting frame disposed on at least one supporting structure in a respective station;

a plurality of control tires mounted on said supporting frame in the stations, said control tires including decelerating tires disposed to decelerate said vehicles upon entering a respective station, conveying tires disposed to move said vehicles through the station, and accelerating tires for accelerating said vehicles towards a speed of said hauling cable before being coupled to said hauling cable;

a pivotally mounted rocker carrying at least one of said supporting pulleys and a drive belt connected between said at least one supporting pulley and at least one of said control tires for driving said control tires by way of said at least one supporting pulley in the respective station, wherein a drive of said control tires is diverted from said hauling cable by way of said at least one supporting pulley and said drive belt;

said pivotally mounted rocker being mounted on a supporting structure to which said supporting frame is not attached.

2. The cable car system according to claim 1, wherein said at least one supporting structure for said supporting frame consists of a support column and a cross beam disposed thereon, said cross beam having two ends and said at least one rocker is mounted at one of said two ends of said cross beam.

3. The cable car system according to claim 2, wherein a support beam on which said at least one rocker is mounted is disposed at an end of said cross beam.

4. The cable car system according to claim 1, wherein:

said supporting frame for said control tires is disposed on at least one supporting structure comprising a support column and a cross beam and a further support column is provided with a cross beam having an one end carrying said at least one rocker on which said at least one supporting pulley is mounted, and wherein said supporting frame is not attached to said cross beam.

5. The cable car system according to claim 1, wherein said rocker is one of two pivotally mounted rockers on which two supporting pulleys are mounted and which are each coupled via a drive belt to at least one of said control tires.

6. A cable car system, comprising:

a hauling cable extending between stations of the system and being guided over supporting pulleys and reversing pulleys in the stations;

vehicles to be coupled to said hauling cable along a route between the stations and decoupled from said hauling cable upon entering the stations, whereupon said vehicles are guided through the stations along guide rails to enable passengers to embark and disembark, and said vehicles are once more coupled to said hauling cable on exiting the stations;

a supporting frame disposed on at least one supporting structure in a respective station;

a plurality of control tires mounted on said supporting frame in the stations, said control tires including decelerating tires disposed to decelerate said vehicles upon entering a respective station, conveying tires disposed to move said vehicles through the station, and accelerating tires for accelerating said vehicles towards a speed of said hauling cable before being coupled to said hauling cable;

a pivotally mounted rocker carrying at least one of said supporting pulleys and a drive belt connected between said at least one supporting pulley and at least one of said control tires for driving said control tires by way of said at least one supporting pulley in the respective station, wherein a drive of said control tires is diverted from said hauling cable by way of said at least one supporting pulley and said drive belt;

said pivotally mounted rocker carrying said at least one supporting pulley being mounted on said supporting structure for said supporting frame; and said at least one supporting structure for said supporting frame consisting of a support column and a cross beam disposed thereon, said cross beam having two ends and said at least one rocker being mounted at one of said two ends of said cross beam.

* * * * *